US005462176A

United States Patent [19]

Hereford et al.

[11] Patent Number: 5,462,176

[45] Date of Patent: Oct. 31, 1995

[54] LATEX DETECTION SYSTEM

[75] Inventors: Cliff E. Hereford, deceased, late of Haddock, Ga., by Joan A. Hereford, executrix; Joseph H. Malek, St. Petersburg, Fla.

[73] Assignee: Brown & Williamson Tobacco Corporation, Louisville, Ky.

[21] Appl. No.: 253,370

[22] Filed: Jun. 3, 1994

[51] Int. Cl.[6] ..... B07C 5/00

[52] U.S. Cl. ..... 209/577; 209/588; 209/938; 250/223 R; 131/905

[58] Field of Search ..... 209/576, 577, 209/580, 581, 582, 588, 657, 938, 939; 250/223 R, 226; 131/110, 905

[56] References Cited

U.S. PATENT DOCUMENTS

| | | | |
|---|---|---|---|
| 3,004,664 | 10/1961 | Dreyfus | 209/581 X |
| 4,300,689 | 11/1981 | Franklin et al. | 209/588 X |
| 5,190,163 | 3/1993 | Anzai et al. | 250/226 X |
| 5,335,791 | 8/1994 | Eason | 209/588 |
| 5,339,962 | 8/1994 | Sommer, Jr. et al. | 209/577 X |

FOREIGN PATENT DOCUMENTS

| | | | |
|---|---|---|---|
| 8600251 | 1/1988 | WIPO | 209/588 |

*Primary Examiner*—David H. Bollinger
*Assistant Examiner*—Tuan Nguyen
*Attorney, Agent, or Firm*—Charles I. Sherman

[57] ABSTRACT

A method and apparatus for detecting foreign matter in a particulate material stream, particularly tobacco, including an optical scanner, in combination with a camera system with beam splitter and filters, and a computer to process signals from the camera to determine whether foreign matter is present. If foreign matter is detected, a diverter deviates the flow of the contaminated material onto a discharge conveyor.

2 Claims, 6 Drawing Sheets

LATEX DETECTION SYSTEM

BACKGROUND OF THE INVENTION

This invention relates to a method and apparatus for detecting and separating foreign objects that may become mixed in a single-flowing stream of particulate matter being transported on a conveying system. More particularly, the present invention relates to a system for detecting latex material buried in a stream of tobacco leaf product and removing the latex pieces prior to further processing of the tobacco flow. Even more particularly, the present invention relates to a means for detecting latex in a stream of tobacco utilizing a multi-spectral, infrared camera detection system.

Tobacco as delivered for processing into cigarettes may contain undesired foreign material therein. In the early stages of handling the tobacco, particularly in the fields during harvesting and storing, laborers may wear latex gloves and, from time to time, the gloves can come off or pieces of them can get mixed in with the tobacco. Once the contaminated tobacco reaches the processing lines at the manufacturing plants, the pieces of latex may be buried deep in multiple layers of tobacco leaves, said multiple layers often being up to 14–16 leaves deep. In the past, it was necessary to station laborers along conveyor lines to inspect the incoming tobacco and manually remove the foreign material, but because to the naked eye the appearance of latex so resembles the color and shape of tobacco, this manual process has been largely ineffective and tends to substantially slow process and production flow rates.

A system is taught in U.S. Pat. No. 4,657,144 (Marin) which scans the surface of cut tobacco as it flows on a conveyor belt to detect pieces of white paper that may get into the tobacco from the ripping machines used to recycle defective cigarettes. The surface of the tobacco flow is brightly illuminated and the white papers which is far more reflective than tobacco, is detected by measuring spikes in reflectance levels. Air nozzles are then activated to deflect portions of the tobacco containing paper as the tobacco falls from one conveyor line to another.

Marin references another system wherein the surface of cut tobacco as it moves on a conveyor line is scanned by a camera sensitive to certain colors of visible light. An integrated color mapping of the scanned tobacco is compared to the desired color, and the off-color tobacco is rejected using an air nozzle system similar to the one described above.

In both systems referenced above, only the surface of the tobacco is scanned as the material passes beneath an optical sensing device, therefore only foreign material which happens to be on the surface of tobacco bed will be detected and subsequently rejected.

To attempt to circumvent the limitation of mere surface detection, a variation of Marin, as taught in U.S. Pat. No. 4,657,144, scans cut tobacco as it cascades from one conveying system to another, illuminating the tobacco as it falls and detecting reflected light from pieces of paper. When paper pieces are detected, air nozzles provide a fluid blast of air to deflect the contaminated portion of tobacco.

The shortcoming of the prior art is that none detect foreign material having similar color, shape and density as tobacco, such as latex. Further, merely scanning the surface of a tobacco flow does not detect foreign material when it is buried below the surface or layered within leaves. Nor does the prior art overcome the problem that latex has a very similar visual appearance to tobacco, especially when tobacco dust has coated the latex, making it even more difficult to detect by eye or reflective light technology. Thus, a means of scanning through layers of a moving substance to detect foreign material buried therein is desired.

One method in the prior art U.S. Pat. No. 3,004,664 (Dreyfus) teaches determining the presence and concentration of a particular substance in a stationary mixture of substances by means of comparing the intensities of radiations passed through the mixture at a plurality of wave lengths, without requiring a standard reference for each spectral determination. An egg bloodspot detector is taught whereby light is transmitted through an egg, after which the light is split into two beams and each beam, after passing though an aperture for weighting, is filtered for a certain bandwidth and focused onto a photocell. The photocell produces electrical signals which are compared by a voltage detector coupled with an amplitude discriminator, and passed to an activator means.

However, the prior art does not overcome problems encountered when the substance is in motion, nor when the material has varying depths and layers, nor when the material displays problematic diffractions, such as are encountered in certain particulate matter, such as tobacco leaf edges.

SUMMARY OF THE INVENTION

The present invention provides a system for optically detecting and removing foreign material in a bed of particulate matter moving at production flow rates.

Further, the present invention provides a system which detects and removes foreign material which may be similar in size, shape, and color as the standard production material in which it is mixed. Also, the present invention provides a system for detecting and removing foreign material even when it may be completely covered by the standard production material.

Even further, the present invention provides a method and apparatus for optically scanning through a bed of tobacco with near infrared light coupled with a camera means and computer programmed to detect the presence of small pieces of foreign material, particularly latex, mixed in the tobacco, and a flow diverter means which operates in response to detection of the foreign material to divert contaminated portions of the tobacco into a discharge system.

More particularly, the present invention provides an apparatus and method for detecting and removing foreign material in a moving stream of particulate matter, comprising: a first conveyor means spaced from and disposed vertically above second and third conveyor means, the second and third conveyor means being transverse to the first conveyor means and positioned at a discharge end of the first conveyor means; compression assembly for packing the particulate matter to a uniform depth; means for transmitting light through said particulate matter; means for collecting the light and passing it to a camera disposed for sensing multiple regions of near infrared light; a computer in electrical communication with said camera, said computer having a means for digitizing the camera's analog signals into digital data and programmed to analyze said digital data to determine the presence of foreign material within the flow of particulate matter; and a flow diverter means in connection with said computer disposed in the spacing between the first conveyor and the second and third conveyor to remove the foreign material, said flow diverter including means to automatically control the flow of materials from the first conveyor means to either the second or third conveyor means, in response to said computer.

Even more particularly, the present invention provides a method and apparatus for detecting and removing foreign substances in a stream of particulate matter comprising the steps of: causing the stream of particulate matter to pass through a high intensity light source; collecting and transmitting light passing through said particulate matter by means of a series of conventional glass lenses or by fiber optical scanning means; splitting and filtering said light into two discrete wave length bands in the near infrared light region; focusing said split infrared light on detectors to produce analog electrical signals; converting said analog signals into digital data for processing on a computer; executing programs on said computer to compare said digital data at two discrete wave length bands to determine the presence of foreign material; generating an output signal in response thereto; and, rejecting that portion of the particulate material which contains the foreign material as it cascades from a first conveyor means onto a reject conveyor means.

BRIEF DESCRIPTION OF THE DRAWINGS

A better understanding of the present invention will be had upon reading the following description in conjunction with the accompanying drawings in which like parts are identified by like number in which.

DETAILED DESCRIPTION OF THE PREFERRED EMBODIMENTS

1. Overview

Figure 1:
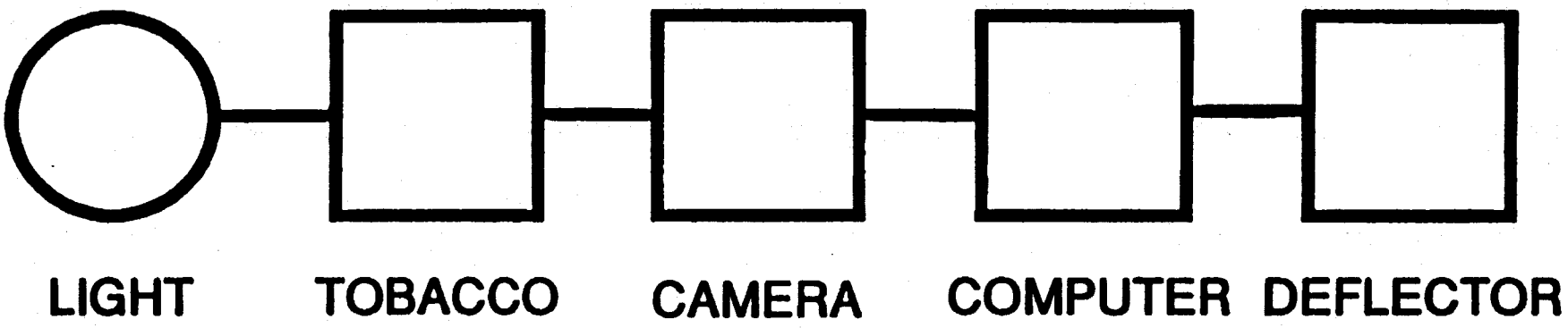
FIG. 1 is a functional block diagram useful for explaining in a general sense the operations and concepts embodied in the present invention.

The block diagram in FIG. 1 shows the basic process steps involve in the detection of undesirables in a tobacco processing system. Firstly, light is transmitted through tobacco into a camera. Secondly, the camera optics split the light into two beams, passing one beam through an 1100 nm filter and the other beam through a 1200 nm filter, onto detectors that send electrical signals to a computer. Thirdly, the computer is programmed to analyze the transmitted data to determine whether foreign material is present. And fourthly, if foreign material is detected, a deflector is activated to divert the tobacco containing the material into a reject area.

Figure 3:
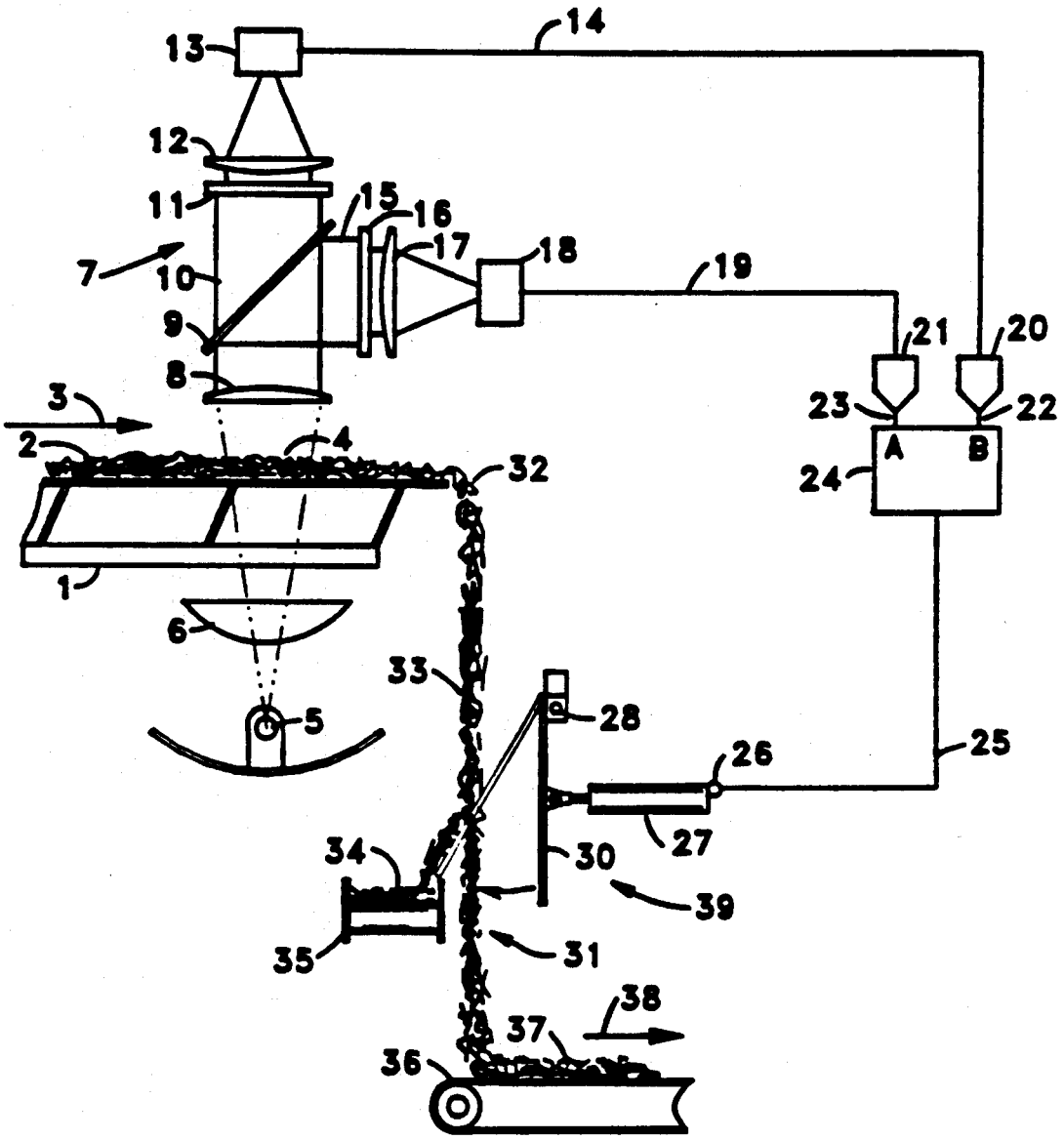
FIG. 3 is a side view of a preferred embodiment of the present invention.

In FIG. 3, a vibrating transparent conveyor belt, identified by the numeral 1, is provided to convey particulate matter, such as tobacco 2, in the direction identified by arrow 3. The tobacco 2 moves past a scanning area 4 in order to detect the presence of foreign materials that may be buried within layers of the tobacco. Tobacco containing foreign material is identified by one of several embodiments described below and rejected by a diverter means 39.

One embodiment of the present invention includes a camera system 7 which operates in response to light transmitted through the tobacco bed at scanning area 4. Radiant energy from light source 5 is transmitted through tobacco 2 into glass lens 8, where the rays are straightened and divided by beam splitter 9 into two beams 10 and 15. Filtering means 11 and 16 select for two discrete bandwidths of near infrared wave lengths for each of the two beams 10 and 15. Lenses 12 and 17 are provided to focus the filtered beams onto detectors 13 and 18, which generate analog electrical video signals 14 and 19, respectively. The video analog signals 14 and 19 are converted by digitizers 20 and 21 into digital video output represented binarily as data channels 22 and 23, respectively. A high speed computer 24 receives data channels 22 and 23 (also identified as values A and B). Computer 24 is programmed to correct for DC variation and gain difference, then sample channels A and B and compare their values by dividing one into the other. When the A/B quotient is greater than +10%, latex is indicated due to the spectral absorption characteristics of latex described hereafter, at which time a diverter means 39 is activated by signal 25 to deflect that portion of the tobacco flow 33 containing the latex.

2. Spectral Characteristics

Figure 2:
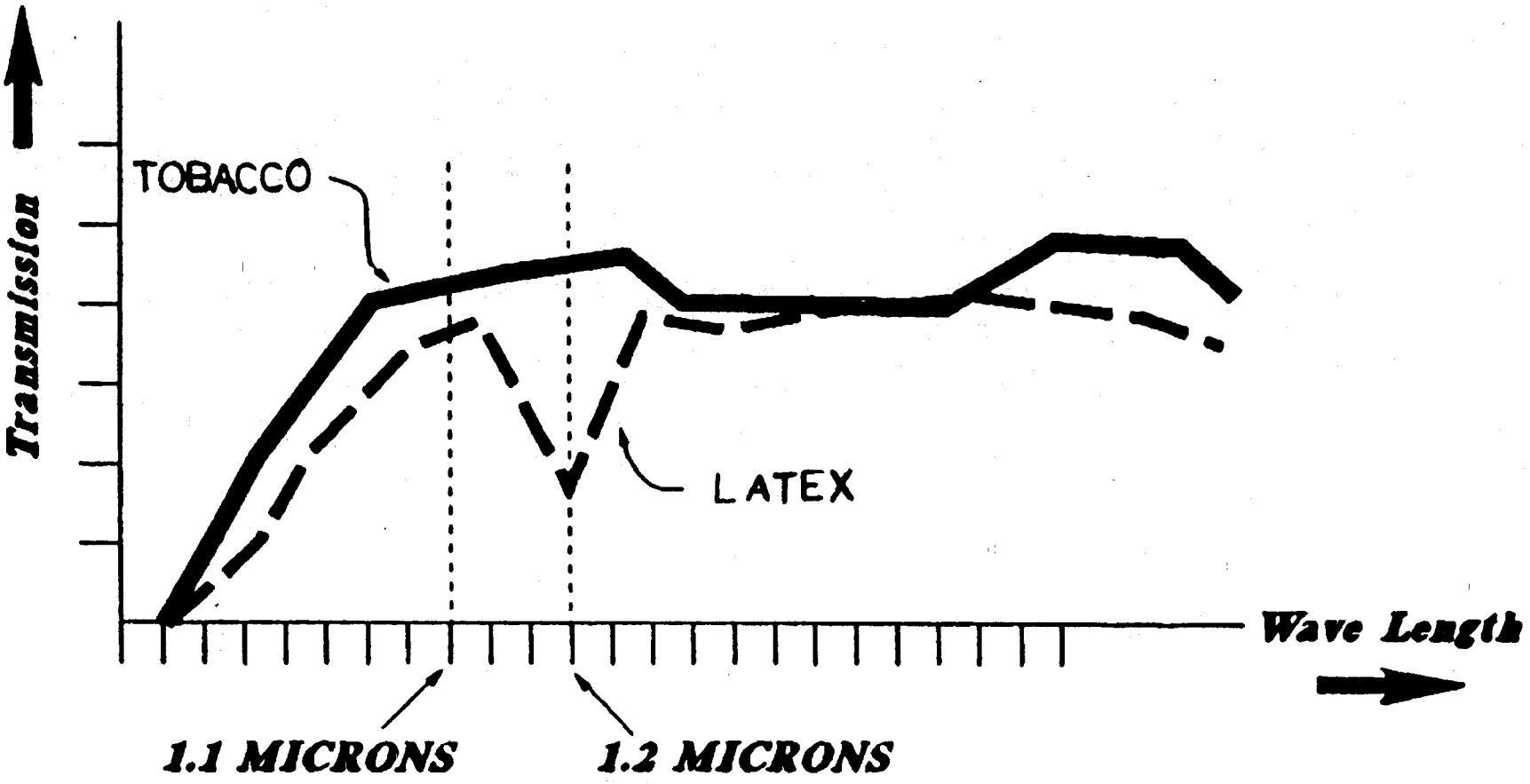
FIG. 2 is a plot of the wave length responses of particulate material, tobacco, and a typical foreign material, latex.

The wave lengths passed by filters 11 and 16 could be selected for any regions of light, but in the present embodiment, the light transmission characteristics of interest are for the materials tobacco and latex. FIG. 2 is a plot of wave lengths showing how tobacco transmits light fairly evenly across the spectrum, but latex has a characteristic transmission drop at approximately 1200 nanometers (nm), which does not appear in tobacco. A second characteristic of interest is the more or less constant transmission levels of both tobacco and latex at approximately 1100 nm. Thus, by using the relatively steady transmission rate at 1100 nm as a background reference, and looking for a sudden drop at 1200 nm is one method for detecting latex mixed in with tobacco.

Referring to FIG. 3, filter 16 passes light at 1100 nm and filter 11 passes light at 1200 nm, producing digital data channels 22 and 23. Computer 24 is programmed to receive said digital data, represented as channels A and B, and divides the value of channel A by the corresponding value of channel B, giving a detection coefficient. When only tobacco is present, the detection coefficient will equal unity since tobacco has about the same transmission characteristics at 1100 nm as at 1200 nm. But when a piece of latex moves in, the value of channel B (1200 nm) drops sharply, causing the detection coefficient to fall below a selected threshold index, such as, for example, a value of 0.91.

3. Conveying System

Figure 6:
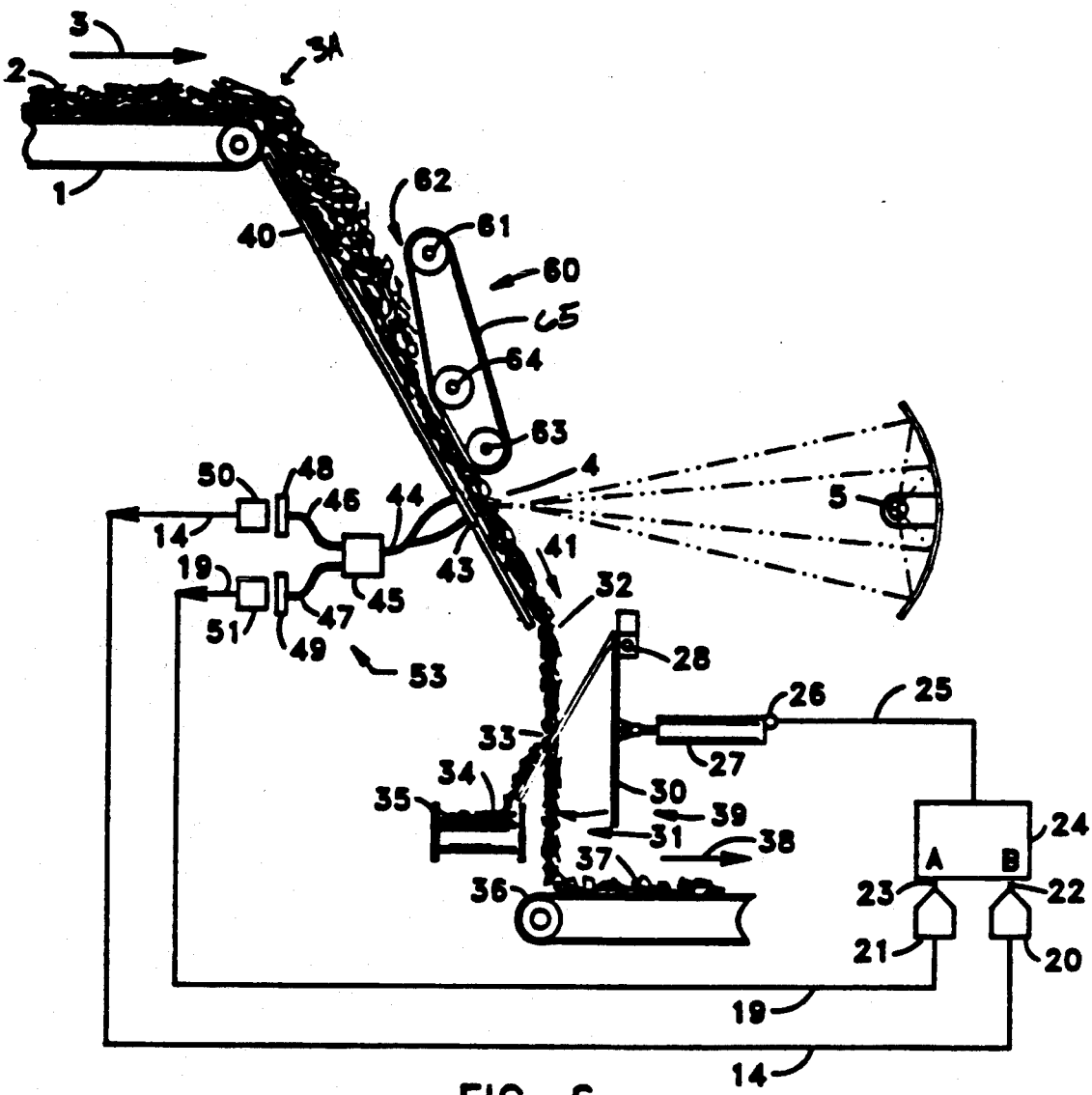
FIG. 6 is a side view of another preferred embodiment of the present invention with a fiber optic camera system.

The vibrating conveyor means 1 shown in FIGS. 3 and 6 is a conventional motor-driven endless belt approximately 4 feet wide, which conveys particulate material at a preselected speed based on production determinations. A means for transmitting light through the stream of particulate matter is provided at scanning area 4. FIG. 6 shows conveyor means 1 transporting the particulate matter to a transfer point 3A where the material discharges onto slide 40, said slide 40 being inclined to a degree such that gravity causes the material to continue flowing at a constant rate. Midway down slide 40, a window 43 is disposed within said slide 40 comprised of a rectangular section of glass, plexiglass, or other transluscent material, which is flush mounted into the bottom of the slide 40. In FIG. 6, window 43 allows light from light source 5 to pass through the tobacco at scanning area 4 into camera system 53, which is disposed behind window 43, as said material falls down slide 40 towards transfer point 32.

As light passes through leafy particulate material, such as tobacco, the rays are diffused and absorbed resulting in loss of energy. In addition, the edges of cut tobacco tend to have a considerable diffusion effect. Thus, the deeper the bed of material, the greater the loss of energy. Moreover, if the depth of the tobacco bed is not constant, the amount of light passing through the material varies proportionally. Therefore, a uniform depth of particulate matter is desirable.

FIG. 6 embodies a means for compressing tobacco to a uniform depth. Immediately before the material flows through scanning area 4, a compression roller 60, mounted above and in a parallel plane to the surface of slide 40, is disposed so as to lightly pack the tobacco to a uniform depth of approximately 1 inch. The compression roller assembly 60 is pivotally mounted at point 62 to allow adjustable height from the surface of the slide. The assembly consists of an endless belt 65 that runs on rear drive roller 61, and two lead rollers, 63 and 64, said lead rollers disposed within the assembly so as to hold belt 65 equi-distant from and parallel to the slide surface 40. In addition, the compression belt 65 turns in the direction of the flow 41 to assist in the unimpeded movement of tobacco in an even and predictable volume and speed. Should tobacco back up in the feed area behind and above the drive roller 61, a photoelectric sensor (not shown) detects the condition and activates an air cylinder to automatically lift compressor assembly 60 to allow passage of any excess tobacco.

4. Camera System a. Conventional Lens Camera System. In the embodiment shown in FIG. 3, a light source 5 is situated below the conveyor means 1 and a camera system 7 is mounted above, although their respective positions could easily be reversed. In one embodiment of the present invention, light source 5 consists of a plurality of high intensity axial incandescent lamps, such as, for example, the Sylvania 1500 watt lamp type 58559, are positioned within a parabolic linear reflector that is located directly beneath the conveyor 1 where the tobacco 2 is moving at production flow rates through scanning area 4. Light passing through lens 6 produces a focused beam at the back plane of scanning area 4, which passes through window 43. Camera 7, mounted perpendicular to and immediately above scanning area 4, at a height of about 12 to 20 inches, collects light passing through the tobacco in scanning area 4 by means of a conventional convex glass lens 8 disposed within said camera system 7, which lens refracts and straightens the rays, and passes them to a beam splitter 9, such as, for example, a polka-dot beam splitter made by the Oriel Company, which splits the beam into two identical beams 10 and 15.

Figure 7:
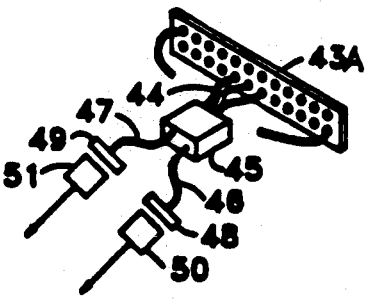
FIG. 7 is an enlargement of the fiber optic camera system, as referenced in FIG. 6.
Figure 8:
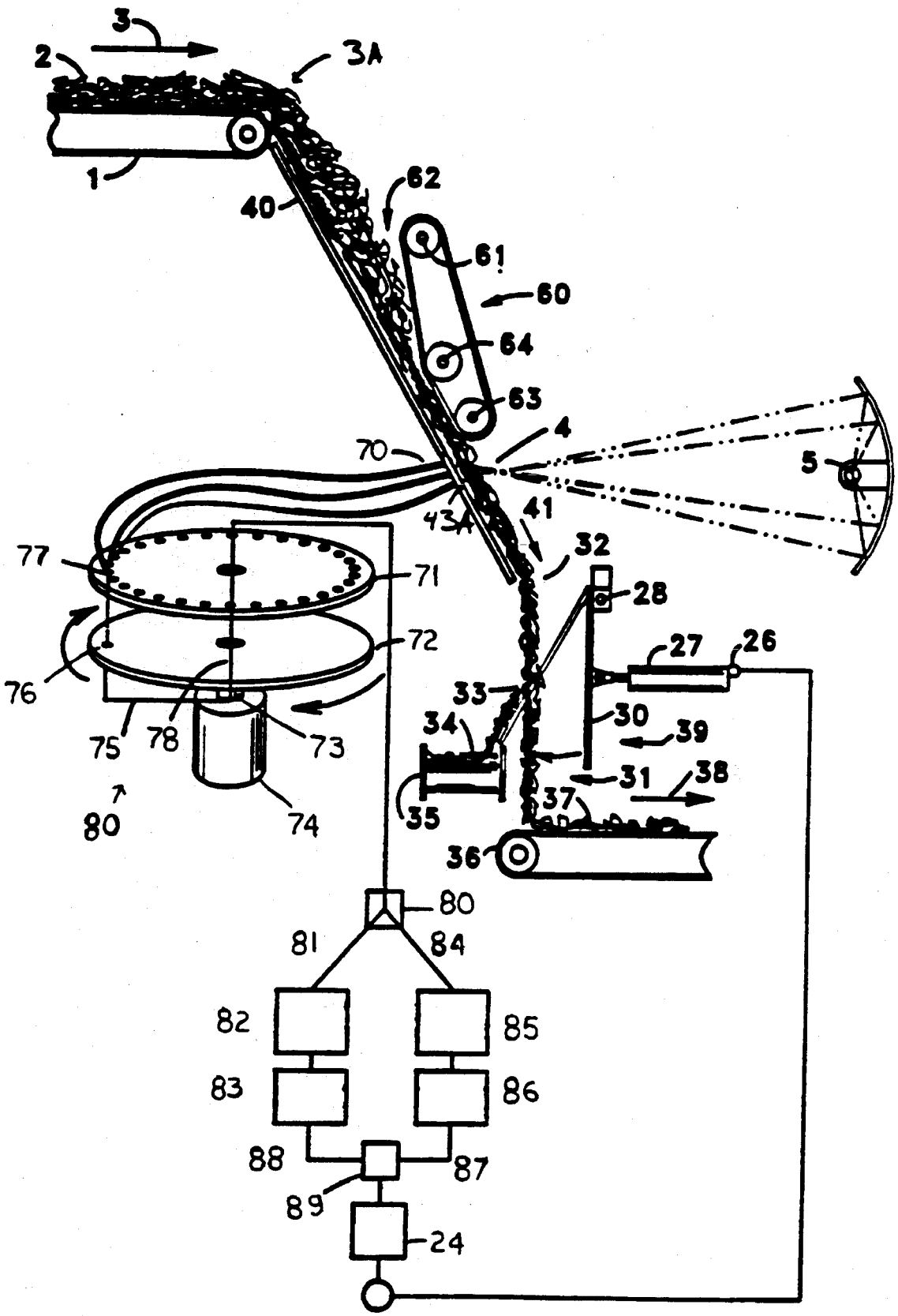
FIG. 8 is a side view of another preferred embodiment of the present invention, with a rotating scan disk adapted to the fiber optic camera system.

Beam 10 passes through color filter 11, which selects in the near-infrared region of 1200 nm, and is condensed by a concave glass lens 12 onto a radiation detector 13, such as, for example, an indium gallium arsenide thermoelectrically cooled thyristor, such as is available from Electro-Optical Systems of Manchester, Pa. Concurrently, beam 15 passes through color filter 16, which selects for 1100 nm, and is focused by concave lens 17 onto detector 18 which operates in the same fashion as detector 13. The detectors 13 and 18 generate electrical outputs as analog signals 14 and 19, respectively, where the analog DC signals indicate the relative transmission strength of the light in each of the two selected infrared wave lengths. The analog signals are subsequently processed by computer 24 as described below.

b. Fiber Optic Camera System. An alternate embodiment of the glass lens camera system just described, is a camera system using fiber optic cables to collect, transmit and split the light energy. Such embodiment is shown in FIG. 6, where the positions of the light source 5 and the camera system 53 are reversed from the positions shown in FIG. 3, with the light source 5 above and the camera system 53 below. As shown in detail in FIG. 7, window 43 is replaced by a linear optical collector plate 43A containing parallel rows of apertures, for example, 3 rows of 25 apertures, where each aperture contains a fiber optic input cable 44 fitted with a pickup lens mounted flush with the outward surface of plate 43A. These input cables receive light from scanning area 4 and are then bundled together, resulting in some of the light beams blending together, thereby causing a more uniform mixture of light to minimize leaf edge effects. The bundle of input cables 44 is then split by means of a fiber optic bundle splitter 45 into two fiber optic cables 46 and 47, each containing light of the identical wave length and intensity as input cables 44. The light in cables 46 and 47 is then passed through near infrared filters 48 and 49, respectively, where filter 48 selectively passes light at 1100 nm and filter 49 selectively passes light at 1200 nm. The light from cables 46 and 47 is then directed onto radiation detectors 50 and 51, respectively, which operate in the same manner as detectors 13 and 18 in FIG. 3 to produce analog signals for subsequent processing by computer 24.

c. Scanned Infrared Camera. FIG. 8 shows an improvement to the fiber optics just described where the plurality of input fiber optic cables 70, rather than being bundled together, are coupled to a fixed disk 71 in a concentric ring along the periphery of fixed disk 71 in apertures 77 that allow light to exit the input cables 77 into the space below. Immediately below and disposed in a parallel plane to said fixed disk 71 is a rotating scan disk 72 of identical size, which is centrally mounted to the spindle 73 of an electric motor 74 with timing means so as to rotate at approximately 1800 rpm. The fixed disk 71 and the rotating scan disk 72 are separated by a gap of approximately 0.5 mm. A U-shaped fiber optic scan cable 75 is affixed into an aperture of scan disk 72 such that one end 76 terminates at and is aligned with the plurality of input cable terminations 77 arranged in fixed disk 71 in a concentric ring. As scan disk 72 spins, light passes from the input cables 70 serially into the scan cable 75 causing pulses of radiant energy. These light pulses are transferred out the opposite end of the U-shaped scan cable 75 into fiber bundle 78 and passed through fiber optic beam splitter 80, where light from the cable 81 is passed through 1100 nm filter 82 onto detector 83, and light from the cable 84 is passed through 1200 nm filter 85 onto detector 86. The optical energy at each detector 83 and 86 is a series of pulses from each input fiber cable 70 being scanned by scan fiber 75. The positive peak of each pulse represents the energy being transmitted through the tobacco at the particular wavelength for the detector. The negative peaks represent a black level or minimal energy into the detector. The analog signals 87 and 88 are passed to digitizer 89 and computer 24 for subsequent processing.

5. Computer Processing a. Data Conversion. Referring to FIG. 3, after the video analog signals 14 and 19 have been produced by detectors 13 and 18, the next phase of operation is to transfer those signals to computer 24 for processing in a digital format the computer can recognize. During analog to digital conversion, the incoming analog signal, a waveform, is sampled at specific time intervals. These samples are then quantized, or converted from the continuous range of energy represented by an analog signal to a predefined range of energy levels that can be dealt with as discrete numbers that can be manipulated by a computer as digital data. Computer 24 may contain a commercially available digitizer board, which converts the analog signals 14 and 19 into digital data 22 and 23, respectively, in this embodiment represented by a range of values of 0 to 65,536 levels. Alternatively, the digitization may be accomplished by circuitry in the camera 7 and sent to computer 24 as digital data to eliminate environmental noise that can sometimes be picked up on a line with analog signals. Thus, in FIGS. 3 and 6, digital data channel A, representing the transmission of light at 1100 nm, and channel B, representing the transmission of light at 1200 nm, are both stored on the computer and accessed by programs running thereon.

b. Signal Conditioning. Computer 24 is programmed to read digital data from channels A and B, and correct for DC variations and gain differences between the two channels. The DC offset correction equalizes level differences between the two channels and the gain correction factor equalizes the gain between the two channels. Alternatively, since analog signals are AC coupled it may be desirable in some instances to restore the DC level prior to digitization as shown in FIG. 8. This may be accomplished by sampling the black level analog signal prior to the positive peak and holding this level in a sample-and-hold circuit. This held level is then added to the positive peak level at digitization time, having the effect of bringing the negative peak level to zero volts or ground. The digitizer may reference this ground when converting the positive peak to a digital value.

Signal gain correction has been found to be necessary because the transmission of camera optics and the detector sensitivity may vary at the two selected wavelengths, which can result in varying signal strengths. Gain correction is also adaptive to the tobacco characteristics and the relative bed thickness and density. For example, signal gain equalization in the scanned infrared camera shown in FIG. 8 may be computed as follows: for each optical aperture (i.e., lens and fiber cables 70 connected to scanner 80) the computer 24 keeps a running time average of the signal levels for each of the two channels 87 and 88. This average mainly represents the tobacco characteristics alone since latex seldomly passes through the system. In theory, without latex present the signal characteristics of the sample for the two wavelengths would be close to identical. In practice, however, the signal levels have been found to differ somewhat due to irregular transmission characteristic of fibers and optics, varying detector sensitivity, and varying light source output at the two wavelengths. Some of the imbalance may be removed by adjusting gain in the video analog electronics, but it has been found that real time gain adjustment is necessary for accuracy. Thus, the ratio of the running average of a channel to an individual data sample is a measure of the imbalance, which ratio may be used as a reference to correct the gain of individual samples and to equalize the signal levels of the channels. Ideally, the ratio of corrected two channel data of individual samples in the absence of latex should approach unity so that when latex passes through the system the signal level in one channel sharply decreases and the ratio of the two channels drops.

c. Detection Logic. In a preferred embodiment, the computer contains a high speed 32-bit microprocessor, such as, for example, a Motorola 68040 or an Intel i960. After digitization and signal conditioning, the channels are sampled periodically and the adjusted value of channel A is divided by the adjusted value of channel B, giving a detection coefficient. The detection coefficient is the ratio of channel A's corrected value divided by channel B, corrected value. The detection coefficient is compared to a preselected threshold level. If only tobacco is present, the quotient will approximate unity, or one (1.0), since tobacco has nearly the same transmission characteristics at both 1100 nm and 1200 nm. But when a piece of latex moves into scanning area 4, the value of channel A drops, corresponding to the characteristic notch exhibit by latex at 1100 nm (as shown in FIG. 2), thereby causing the detection coefficient to drop proportionately. When the detection coefficient falls below a preselected threshold level, such as for example 0.91, then latex is assumed to be present.

Figure 5:
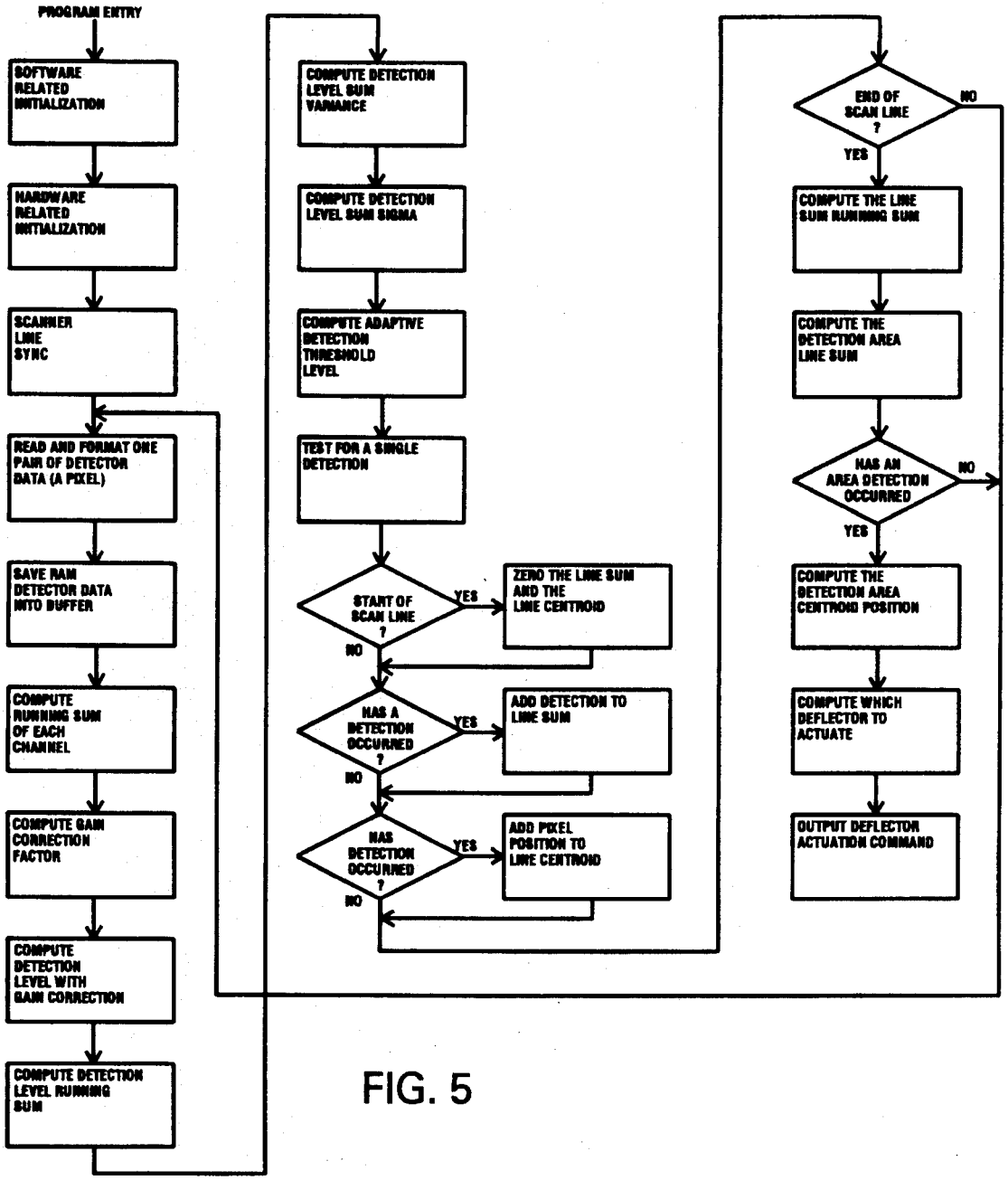
FIG. 5 is a flowchart of the essential steps programmed on a computer embodied in the present invention.

FIG. 5 shows the program logic flow embodied in the scanned infrared camera. The program polls the data for scan lines and reads four bytes or two pixel words at a time. The detection coefficients are analyzed over time with a running sum to determine the statistical variation of the ratio, or its level sum sigma value. This value is then multiplied by a user defined constant and tested against individual ratio values to determine whether they exceed the threshold. A map is maintained of hits where these single detections occurred. One function examines the frequency of hits over time. Another function examines for clusters or "blobs" of individual detections which are a specified percentage greater than the norm. When one or more of these functions determines that latex is actually present, the output routine cause a signal 25 as shown in FIG. 3 to be sent to an RS-232 serial port to activate a diverter means 39 to deflect portions of the tobacco flow 33 containing latex. If the diverter means 39 has more than one deflector paddle 30, the position of the centroid of the clusters is used to determine which paddle 30 to actuate to deflect the latex.

6. Diverter Means

Figure 4:
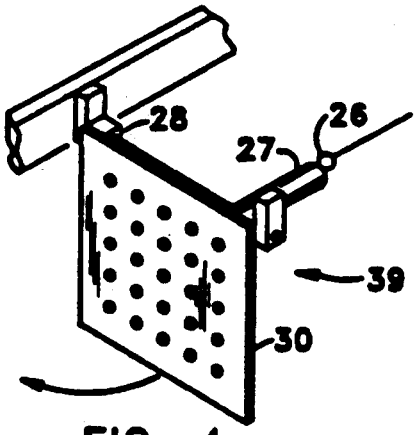
FIG. 4 is a perspective view of the diverter means embodied in the present invention.

When computer 24 determines that foreign material is present in the tobacco, it outputs a deflector actuation command to the diverter means 39 in order to promptly separate the contaminated material from the production flow. The diverter means described below teaches only one means of diverting, although various methods are available. As shown in FIGS. 3 and 6, diverter means 39 is vertically disposed and in line with the flow of tobacco cascading from vibrating conveyor 1 at discharge point 32. Upon detection, computer 24 sends a signal 25 to actuate solenoid valve 26 which operates air cylinder 27 which is operably connected to a perforated sheet, or paddle 30, as shown in a perspective view in FIG. 4. Upon receipt of signal 25, paddle 30 which is hingedly connected to the apparatus by hinge pin 28 moves outwardly in response to a thrust from air cylinder 27, thereby diverting the normal flow of material at point 33 onto reject conveyor 35, which is transverse to vibrating conveyor 1. The reject tobacco 34 is carried away for subsequent processing. Tobacco 37, which does not contain foreign material, falls normally onto conveyor 36 where it is carried away in the direction of arrow 38 for subsequent processing into cigarettes. One variation of the diverter means is to use a plurality of paddles across the width of the tobacco cascade to selectively reject only the areas actually containing latex. Another variation of the diverter means is to remove contaminated tobacco by means of vacuum tubes disposed to suck tobacco containing the foreign material off the production line.

The foregoing detailed description is given primarily for the clearness of understanding and no unnecessary limitations are to be understood therefrom for modifications can be made by those skilled in the art reading this disclosure and may be made without departing from the spirit of the invention and scope of the appended claims herein.

What is claimed is:

1. A method of detecting and removing foreign material from a stream of particulate matter on a conveying system comprising the steps of:

transporting said particulate matter past an optical scanning area;

transmitting light through said particulate matter into a camera system;

splitting said light within said camera system into first and second beams;

filtering said first and second beams for selected wavelengths;

detecting said first and second beams to provide first and second analog signals to a computer;

converting said first and second analog signals to first and second digital channels;

running programs to analyze said first and second digital channels to send output signals to a diverter when foreign material is detected, said programs computing a detection co-efficient to determine the occurrence of a foreign material, mapping the occurrences of foreign material and comparing the frequency and location of said occurrences of foreign material to a preselected threshold level; and, diverting said foreign material from said stream of particulate matter in response to said output signals.

2. A method of detecting and removing foreign material from a stream of particulate matter on a conveying system comprising the steps of:

transporting said particulate matter past an optical scanning area;

transmitting light through said particulate matter into a camera system;

splitting said light within said camera system into first and second beams;

filtering said first and second beams for selected wavelengths;

detecting said first and said second beams to provide first and second analog signals to a computer;

converting said first and second analog signals to first and second digital channels;

running programs to analyze said first and second digital channels to send output signals to a diverter when foreign material is detected, said programs computing a detection co-efficient to determine the occurrence of a foreign material by sampling said first and second digital channels to give first and second digital values and dividing said first digital value by said second digital value to give said detection co-efficient;

mapping the occurrences of foreign material and comparing the frequency and location of said occurrences of foreign material to a preselected threshold level; and, diverting said foreign material from said stream of particulate matter in response to said output signals.

* * * * *